US006395110B2

(12) United States Patent
Mizoguchi et al.

(10) Patent No.: US 6,395,110 B2
(45) Date of Patent: May 28, 2002

(54) COPPER-BASED ALLOY EXCELLING IN CORROSION RESISTANCE, METHOD FOR PRODUCTION THEREOF, AND PRODUCTS MADE OF THE COPPER-BASED ALLOY

(75) Inventors: Tadao Mizoguchi; Kozo Itoh; Kazuaki Yajima, all of Nagano (JP)

(73) Assignee: Kitz Corporation, Chiba (JP)

( * ) Notice: Subject to any disclaimer, the term of this patent is extended or adjusted under 35 U.S.C. 154(b) by 0 days.

(21) Appl. No.: 09/402,624

(22) PCT Filed: Apr. 8, 1998

(86) PCT No.: PCT/JP98/01624

§ 371 (c)(1),
(2), (4) Date: Oct. 7, 1999

(87) PCT Pub. No.: WO98/45490

PCT Pub. Date: Oct. 15, 1998

(30) Foreign Application Priority Data

Apr. 8, 1997 (JP) ..... 9-105312

(51) Int. Cl.[7] ..... C22C 9/04

(52) U.S. Cl. ..... 148/433; 148/681; 148/682; 148/554; 420/472

(58) Field of Search ..... 148/433, 554, 148/681, 682; 420/472

(56) References Cited

U.S. PATENT DOCUMENTS 4,101,317 A 7/1978 Okano ..... 75/156.5
5,445,687 A 8/1995 Sukegawa et al. ..... 148/433
5,507,885 A 4/1996 Sakai et al. ..... 148/434

FOREIGN PATENT DOCUMENTS

| | | | |
|---|---|---|---|
| DE | 4233668 | * | 5/1993 |
| JP | 60-56036 | | 4/1985 |
| JP | 7-68595 | | 7/1995 |
| JP | 7197152 | * | 8/1995 |
| JP | 7-207387 | | 8/1995 |

* cited by examiner

*Primary Examiner*—Sikyin Ip
(74) *Attorney, Agent, or Firm*—Wenderoth, Lind & Ponack, L.L.P.

(57) ABSTRACT

The present invention provides a copper-based alloy characterized by: having a composition of 58.0 to 63.0% by weight of Cu, 0.5 to 4.5% by weight of Pb, 0.05 to 0.25% by weight of P, 0.5 to 3.0% by weight of Sn, 0.05 to 0.30% by weight of Ni, and the balance of Zn and inevitable impurities; having a texture uniformly fragmented to acquire excellent corrosion resistance and hot working property; having undergone a given drawing work and heat treatment to acquire excellent mechanical properties including tensile strength, proof strength and elongation; and having internal stress thoroughly removed to excel in stress-corrosion cracking resistance. Therefore, it is possible to provide a copper-based alloy having the hot forging property that is inherent in a Pb-containing brass, exhibiting excellent dezincification corrosion resistance, economical because the use of P for improving corrosion resistance results in further lowering the cost of raw material, and exhibiting excellent stress-corrosion cracking resistance because it is subjected to a given drawing work and heat treatment.

13 Claims, 12 Drawing Sheets

Results of test for forging property

| No | extruding temperature (°C) | extruding point | material texture G/S (μm) | test for elongation in forging | | | | | | | |
|---|---|---|---|---|---|---|---|---|---|---|---|
| | | | | appraisal | | | | | | | |
| | | | | 680°C | | 720°C | | 760°C | | 800°C | |
| 1 | 770 | head | 21.8 | C | X | B | X | B | O | D | X |
| | | middle | 19.2 | C | | A | | A | | D | |
| | | end | 19.8 | C | | C | | A | | D | |
| 2 | 650 | head | 13.1 | A | O | A | O | B | O | B | Δ |
| | | middle | 13.7 | A | | A | | A | | B | |
| | | end | 12.5 | A | | A | | A | | B | |

appraisal

A: good (with no crack or roughness)
B: rough (with no crack)
C: with small cracks
D: with cracks
E: with large cracks

X200 with no dezincification corrosion

X200 with no dezincification corrosion

X50

X50

COPPER-BASED ALLOY EXCELLING IN CORROSION RESISTANCE, METHOD FOR PRODUCTION THEREOF, AND PRODUCTS MADE OF THE COPPER-BASED ALLOY

This application is a 371 application of PCT/JP98/01624 filed Apr. 8, 1998.

TECHNICAL FIELD

This invention relates to a copper-based alloy excelling in corrosion resistance, a method for the production thereof, and products made of the copper-based alloy, and more particularly to a copper-based alloy, namely a material which requires dezincification corrosion resistance in the presence of a corroding aqueous solution and which is utilized as a machining material, used in a field requiring a hot processing property such as hot forging property, further utilized in a state having stress such as of caulking applied thereto, and moreover utilized extensively in a field requiring stress-corrosion cracking resistance as well as dezincification resistance, a method for the production thereof, and products made of the copper-based alloy.

BACKGROUND ART

As copper-based alloy materials, a forging brass bar (JIS C3771), a free-cutting brass bar (JIS C3604), a naval brass bar (JIS C4641), a high-strength brass bar (JIS C6782), and the like are generally known.

Since these copper-based alloys have various defects and do not prove satisfactory, various improved copper-based alloys have been proposed heretofore.

The present applicant has already proposed a copper-based alloy excelling in dezincification corrosion resistance and hot processing property as published in JP-A-07-207, 387.

Though the alloy of this publication exhibits fine characteristic properties and find actual utility in a wide range of fields, it has evolved the below-mentioned problematic point with the elapse of time of actual service. The desirability of developing an improvement directed at overcoming the problems, therefore, has been finding growing recognition.

To be more specific about this point, in a test for dezincification corrosion to be performed in the atmosphere of a corrosive liquid, this alloy possibly succumbs to local corrosion. Further, this copper-based alloy, when used as a cutting material or used in a state exposed to stress such as caulking, possibly sustains a stress-corrosion crack.

This invention has been perfected by a diligent study initiated in the light of the problematic point mentioned above. It has for an object thereof the provision of a copper-based alloy exhibiting a fine dezincification corrosion resistance in the atmosphere of a corrosive liquid and excelling in hot processing property and stress-corrosion cracking resistance, a method for the production thereof, and products made of the copper-based alloy.

DISCLOSURE OF THE INVENTION

One aspect of this invention concerns a copper-based alloy having a composition of 58.0 to 63.0% of Cu, 0.5 to 4.5% of Pb, 0.05 to 0.25% of P, 0.5 to 3.0% of Sn, 0.05 to 0.30% of Ni, and the balance of Zn and inevitable impurities (weight %) and having the ratio of P and Sn so adjusted as to satisfy the expression, P (%)×10=(2.8 to 3.98) (%)−Sn (%). The copper-based alloy has its texture fragmented uniformly to exhibit excellent corrosion resistance and excellent hot processing property. Furthermore, when having undergone a proper drawing work and heat treatment it is improved in tensile strength, hardness, elongation, etc. Moreover, it excels in stress-corrosion cracking resistance when its internal stress has been thoroughly removed.

The copper-based alloy can further contain 0.02 to 0.15% by weight of Ti.

The copper-based alloy is produced by extruding a billet at a predetermined temperature and heat-treating the product of extrusion at a temperature of not more than the predetermined temperature, thereby adjusting its metal composition so that the average crystal grain diameter is not more than substantially 20 $\mu$m.

In the extrusion step, the billet extruding temperature is preferably lowered to not more than 680° C. to uniformly fragment the crystal grains of the texture of the extruded bar material.

In the production process, the extruded billet is subjected to a proper drawing work and heat treatment or to forging and then heat treatment in a temperature region of 475 to 600° C. for a period in the range of 1 to 5 hours.

Another aspect of this invention concerns a copper-based alloy produced by extruding a relevant cast billet, heat-treating the product of extrusion in a temperature region of 475 to 600° C. for a period in the range of 1 to 5 hours, and subjecting the heat-treated product to a proper drawing work.

The drawing work is effected by a plastic processing at a 10 to 30% ratio of area reduction for the purpose of exalting material strength.

After the plastic processing, the plasticized product is further heat-treated at a temperature in the range of 250 to 400° C. for a period in the range of 1 to 5 hours for the purpose of performing the adjustment of material and the removal of residual stress.

By this method of manufacture, it is made possible to obtain a copper-based alloy which excels in stress-corrosion cracking resistance because the method thoroughly performs the adjustment of material (tensile strength not less than 400 N/mm$^2$, elongation not less than 25%, and hardness not less than Hv 100) and the treatment for removal of residual stress.

The copper-based alloy was used as a raw material to produce water-contacting parts such as valves, joints, pipes, water faucets, supplies for water or hot-water feeding, etc., or electrical mechanical products such as gas appliance parts, washing machine parts, air conditioner parts, etc. The results were good.

In the case of extruding the alloy of this invention mentioned above, by lowering the heating temperature of the billet to a level of not more than 680° C. prior to the extrusion, thereby uniformly fragmenting the crystal grains of the texture, of the bar material to a diameter of not more than 20 $\mu$m, the copper-based alloy to be produced is enabled to acquire an excellent hot processing property.

The copper-based alloy mentioned above owns the hot forging property which is inherent in a Pb-containing brass, exhibits an excellent dezincification corrosion resistance, and fits the work of hot processing. This alloy further abounds in economy because the use of P for the sake of improving corrosion resistance results in further lowering the cost of raw material.

A drawing work and a heat treatment additionally performed suitably allow the copper-based alloy to exhibit stress-corrosion cracking resistance effectively.

According to this invention, therefore, it has become possible to provide a copper-based alloy which manifests an excellent effect in dezincification corrosion resistance, stress-corrosion cracking resistance, and hot processing property and abounds in economy as well.

The copper-based alloy of this invention excels in respect of strength besides excelling in corrosion resistance, hot processing property, and stress-corrosion cracking resistance as described above. When this alloy is used, for example, for valves, taps, and parts thereof which need prescribed magnitudes of pressure resistance as pressure vessels, therefore, it allows these vessels to decrease their wall thicknesses as compared with the vessels of the conventional alloy. Further, it enjoys highly satisfactory workability as compared with the conventional alloy because it excels in susceptibility to the cutting work and therefore permits a reduction in the time required for the work of cutting performed thereon and further because it manifests a high hot processing property and therefore permits a cut in the time required for the work of processing performed thereon.

BEST MODE FOR EMBODYING THE INVENTION

The range of composition of the copper-based alloy according to this invention and the reason therefor will be described below.

Cu: Though an increase in the amount of Cu results in exalting the dezincification corrosion resistance of the alloy, Cu has a higher unit price than Zn. In consideration of the desirability of repressing the cost of raw materials and the excellence of the hot forging property forming the primary target of this invention, the proportion of Cu in the composition of the alloy is set at a range of 58.0 to 63.0%. Particularly, the range of 60.0 to 61.5% has been found to bring satisfactory results.

Pb: The alloy incorporates Pb therein for the purpose of enabling the forged product thereof to be improved in the susceptibility to the cutting work. If the proportion of Pb is less than 0.5%, the produced alloy will fail to acquire fully satisfactory susceptibility to the cutting work. If Pb is incorporated in an unduly large amount, the produced alloy will be deficient in tensile strength, elongation, impact value, etc. Thus, the range for the proportion of Pb is set at 0.5 to 4.5%. Particularly, the range of 1.7 to 2.4% has been found to bring satisfactory results.

Figure 1:
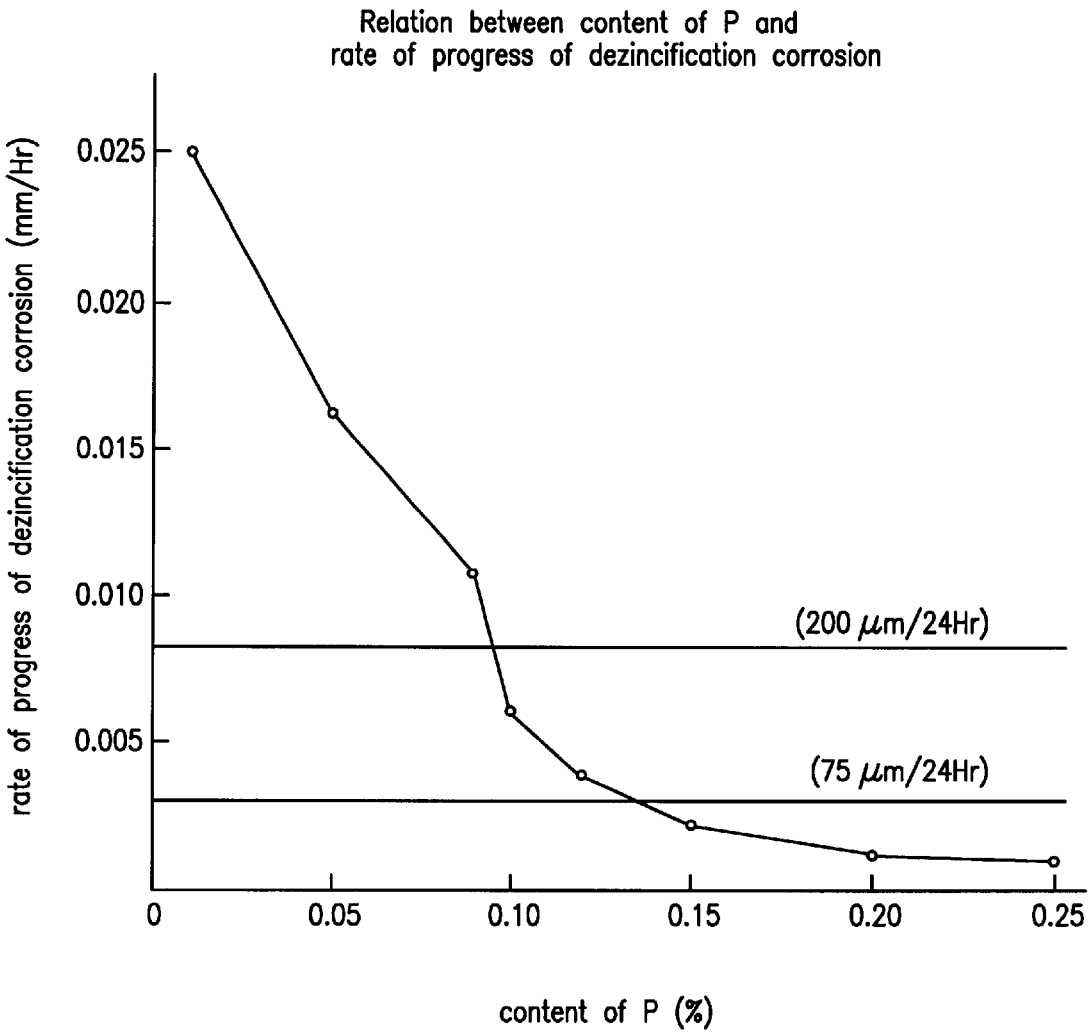
FIG. 1 is a graph showing the relation between the content of P and the rate of progress of dezincification corrosion.

P: The alloy incorporates P therein for the purpose of acquiring improved dezincification corrosion resistance. The alloy gains in dezincification corrosion resistance in proportion as the amount of P added is increased as shown in FIG. 1. If the P content increases, however, the compound $Cu_3P$ to be formed between P and copper will be precipitated in the boundary of crystal grains. Since this compound is hard, brittle, and liable to melt during the work of hot processing, it tends to cause the alloy to sustain hot cracking during the work of extrusion or hot forging. The range of the proportion of P is set at 0.05 to 0.25% because it satisfies the dezincification corrosion resistance which is the primary target of the alloy of this invention. Particularly, the range of proportion of 0. 07 to 0.10% which has no adverse effect on the hot forging property has been found to bring satisfactory results.

Figure 2:
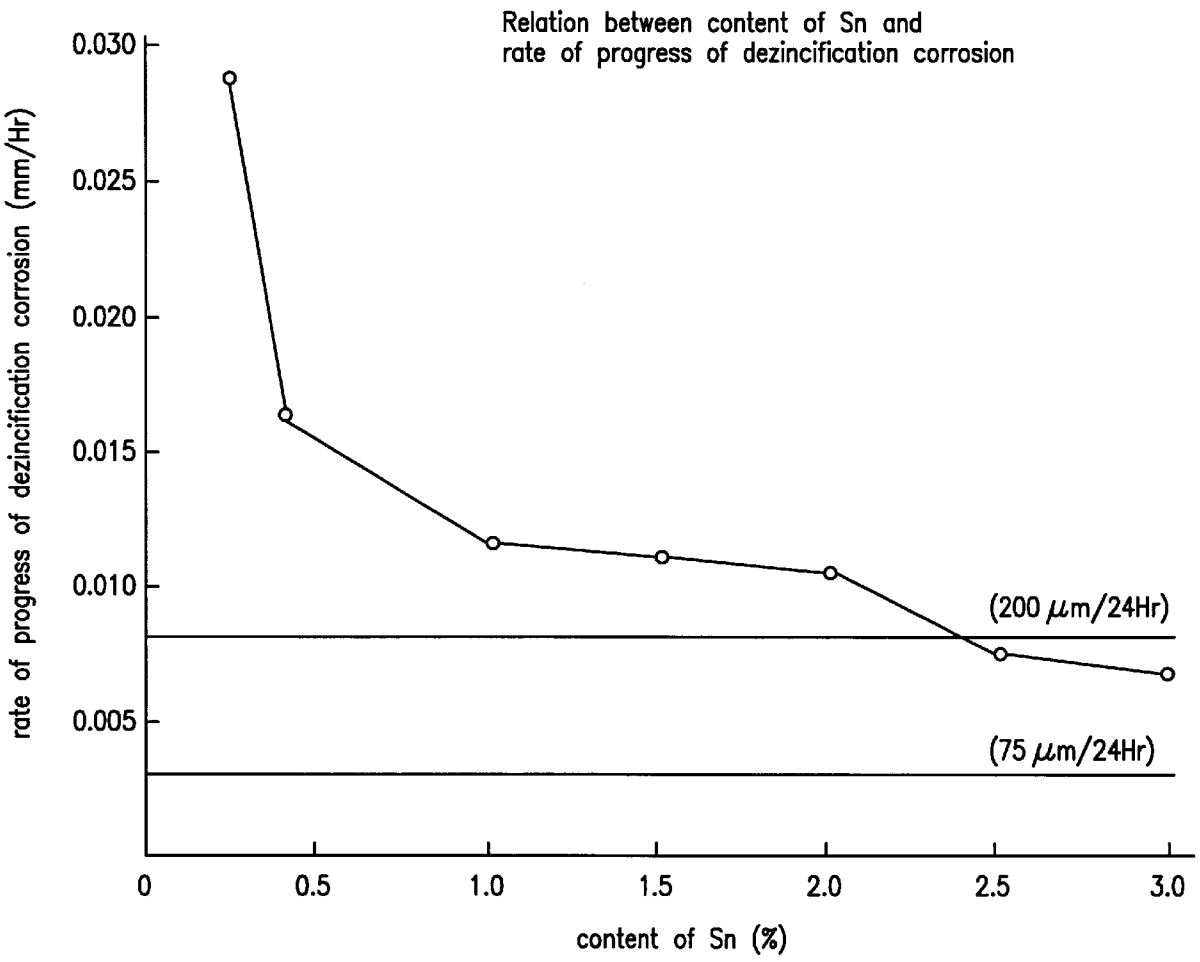
FIG. 2 is a graph showing the relation between the content of Sn and the rate of progress of dezincification corrosion.
Figure 3:
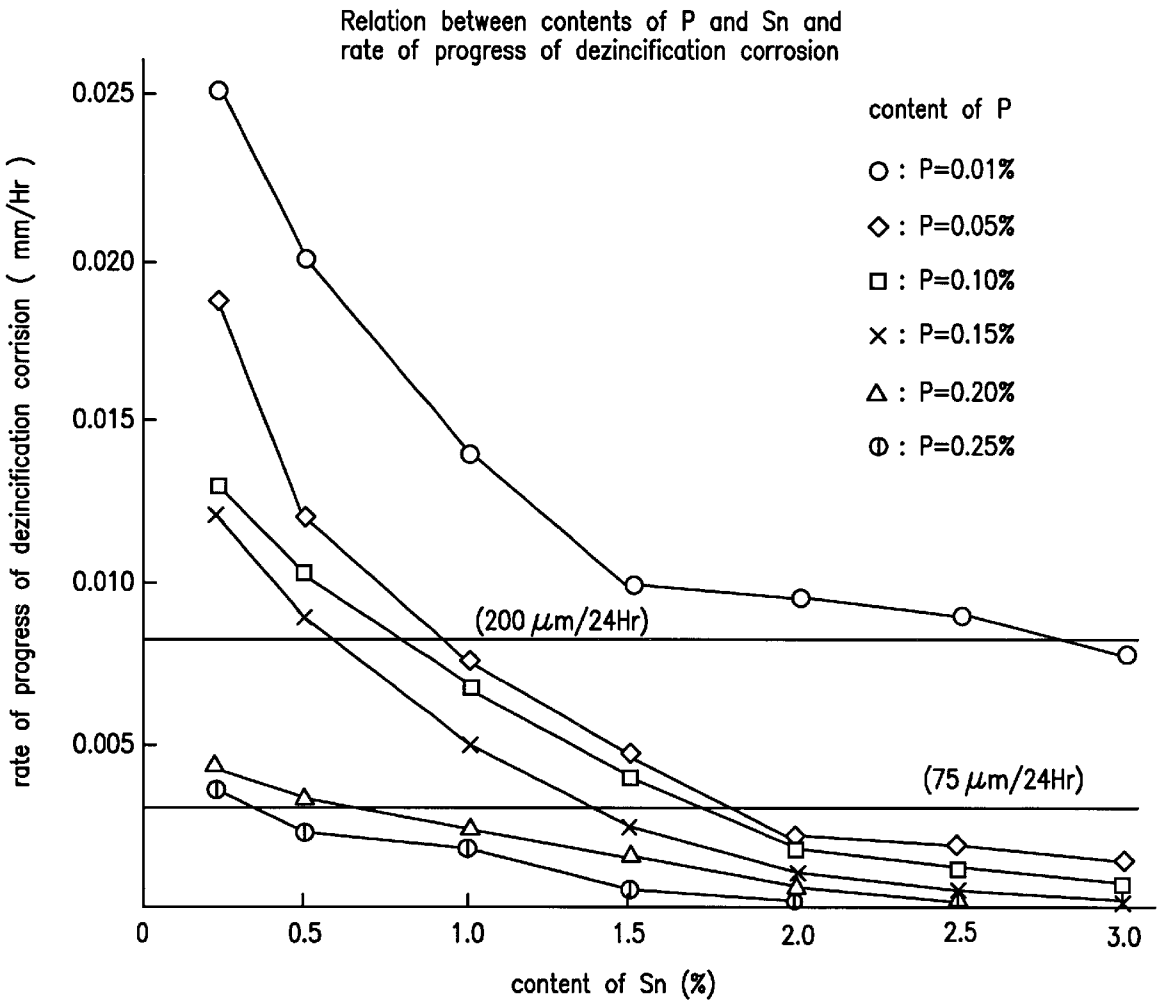
FIG. 3 is a graph showing the relation between the contents of P and Sn and the rate of progress of dezincification corrosion.

Sn: The alloy contains Sn for the purpose of acquiring improved dezincification corrosion resistance. FIG. 2 is a graph showing the relation between the Sn content (%) and the corrosion. Particularly, the simultaneous addition of Sn and P proves more effective. FIG. 3 is a graph showing the change of corrosion due to the simultaneous addition of P and Sn.

Sn has a higher unit price than Zn. It is appropriate, therefore, to lower the proportion of Sn in view of the cost of raw materials. In consideration of the synergistic erect manifested by Sn in combination with Cu and P, i.e. the components effective in resisting dezincification corrosion, the range of the proportion of Sn, 0.5 to 3.0%, in which this element manifests the dezincification corrosion resistance most favorably, has been adopted. It has been confirmed that the produced alloy particularly excels in dezincification corrosion resistance when the ratio of P and Sn involved in the invention conforms to the formula, P (%)×10=(2.8 to 3.98) (%)−SN (%). Further, the range of the proportion of Sn, 1.0 to 2.5%, brings particularly favorable results. Particularly, the proportion of P that satisfies the formula, P (%)×10=(2.8 to 3.2) (%)−SN (%), proves favorable in consideration of the fact that the hot forging property of the alloy is impaired when the proportion of P is unduly large and the alloy entails excessive precipitation of the γ phage when the proportion of Sn is unduly large.

Ni: The content of Ni in the alloy is directly effective in enabling the alloy to resist dezincification corrosion. This element allows the texture of the alloy in the form of an ingot to be uniformly fragmented and, after the ingot has been processed ag by extrusion and forging, enables the processed alloy to acquire a uniformly fine texture, and manifests consequently as effect in preventing the alloy from dezincification corrosion. The range of the proportion of Ni, therefore, has been set at 0.05 to 0.30%. Particularly, the range of 0.05 to 0.10% has been found to bring satisfactory results.

Ti: The alloy contains Ti for the purpose of promoting the effect of uniformly fragmenting the texture thereof by virtue of the synergistic effect manifested between Ti and Ni. Therefore, the range of the proportion of Ti has been set at 0.02 to 0.15%.

Inevitable impurities: From the viewpoint of the production, the total proportion of the inevitable impurities including Fe, for example, is preferred to be not more than 0.8%. This range is manageable without resorting to any special process so long as the ordinary brass material is manufactured within the range specified by the known JIS specification.

Now, the method for producing a copper-based alloy having component elements adjusted in the range contemplated by this invention will be described below.

In this case, the copper-based alloy which is possessed of dezincification corrosion resistance can be produced at a low cost because the adjustment of components allows use of P, an inexpensive element. This element P even at a minute application rate is effective in resisting dezincification corrosion and is further capable of decreasing the amount of a similarly effective element Sn to be incorporated.

This method of production begins at the step of casting a copper-based alloy having the component elements thereof adjusted within the range of percentage composition of this invention to produce an ingot. Then, at the step of bar production, the ingot billet is extruded at a heating temperature of 700° C., for example, and cold-drawn to produce a bar material. Subsequently, at the step of forging, this bar material is hot-forged at a heating temperature in the range of 650 to 800° C. to mold a product. Further, this product of forging is heat treated in a temperature region of 450 to 600° C. for a period in the range of 1 to 5 hours and air-cooled so as to effect thoroughly the adjustment of alloy texture and the removal of internal stress and produce consequently a copper-based alloy excelling in dezincification corrosion resistance.

Another method of production comprises causing an ingot billet of copper-based alloy having the component elements thereof adjusted within the range of percentage composition contemplated by this invention to be hot-extruded at a heating temperature of 700° C., for example, thereby making a bar material or a coil material, heat-treating the coil material at a temperature in the range of 475 to 600° C. for a period of 1 to 5 hours and air-cooling the resultant hot coil material, then subjecting the coil material to a drawing treatment at a ratio of reduction of area of 10 to 25%, thereby effecting a plastic processing, and further subjecting the drawn coil to an annealing treatment performed at a heating temperature of 250 to 400° C. for a period of 1 to 5 hours and followed by air cooling, thereby effecting material adjustment (tensile strength not less than 400 N/mm$^2$, elongation not less than 25%, and hardness not less than Hv 100) and thorough removal of internal stress. The copper-based alloy which is obtained by the method of production described above excels in dezincification corrosion resistance and further exhibits high strength and an outstanding resistance to stress-corrosion cracking.

Figure 4:
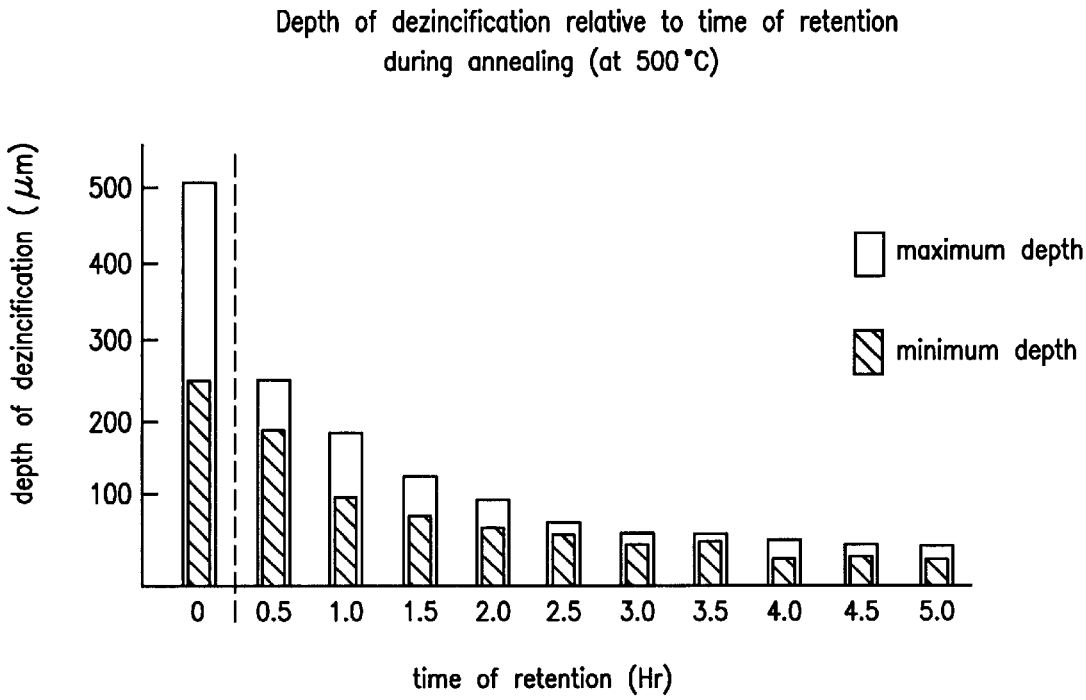
FIG. 4 is a graph showing the depth of dezincification relative to the time of retention during the work of annealing (performed at 500° C.).

FIG. 4 is a graph showing the results of a test for change in depth of dezincification relative to the retention time during the work of annealing.

Figure 5:
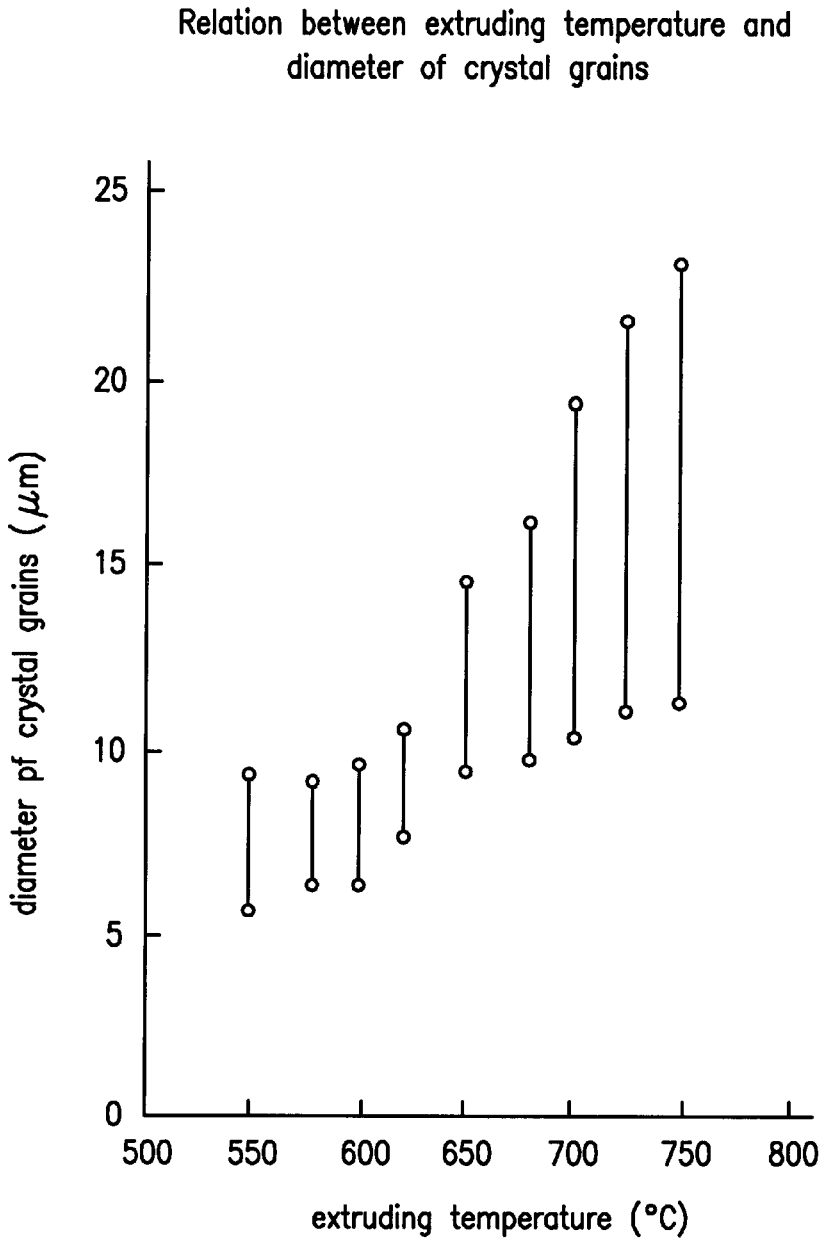
FIG. 5 is a graph showing the relation between the extruding temperature and the diameter of crystal grains.
Figure 6:
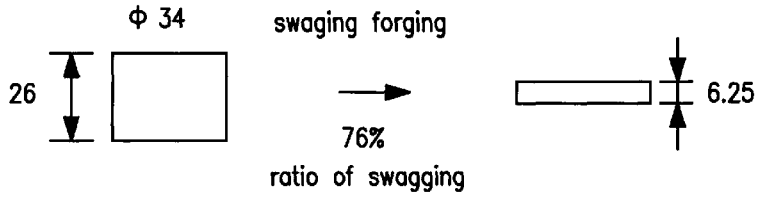
FIG. 6 is a table showing the results of a test for forging property.
Figure 6:
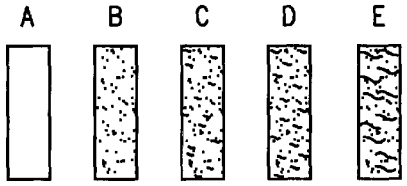

The ingot of copper-based alloy which has the component elements thereof adjusted in the range of percentage composition according to this invention is enabled to be improved in the hot processing property by extruding this ingot at as low a heating temperature as possible and consequently making the crystal grains of the texture of the bar material smaller. FIG. 5 is a graph showing the relation between the extruding temperature and the diameter of crystal grains and FIG. 6 is a graph showing the relation between the diameter of crystal grains and the forgeability.

By these results, it is confirmed that when the billet is extruded at a lowered heating temperature of not more than 680° C. at the step of extrusion, the crystal grains of the textures, α and β, of the bar material are uniformly fragmented and that owing to the uniform fragmentation, the alloy material to be produced excels in hot processing property, particularly in hot forging property. In this case, the hot forging property becomes fully satisfactory when the crystal grains have a diameter of not more than about 20 μm. The results of a test demonstrate that the diameter of not more than 15 μm proves especially favorable.

Now, working examples of application of copper-based alloys of this invention and comparative examples will be described below. The results of a test for dezincification corrosion resistance and a test for hot forging property performed on the relevant samples are shown in Table 1.

The samples for the tests were produced by the known method mentioned above. First, bar materials 25 mm in diameter were produced by causing ingot billets 250 mm in diameter manufactured by the continuous casting method to be extruded by the use of a hot extruding device at an extruding temperature of 700° C. The bar materials were subsequently subjected to a drawing treatment at a ratio of reduction of area of 12.5%.

Test for forging property: An industrial valve part made of the bar material mentioned above was tested for moldability by forging. The valve part was hot-forged at a forging temperature of 700° C. and then visually examined to confirm the outward appearance and the possible infliction of cracks or wrinkles on the surface layer. As means for the confirmation, a stereoscopic microscope capable of 10 magnifications was used. As respects the comparison of moldability, a forged product using the known JIS C3771 (Sample No. 1) material was used as the standard of the state of molding. The samples found equivalent to the standard were indicated with a circle mark, ○, and the samples found inferior thereto with a cross mark, ×.

Test for dezincification corrosion resistance: The samples of valve part obtained after the aforementioned forging were subjected to a heat treatment consisting of standing under the conditions of 550° C.×5.0 hrs and air-cooling to effect adjustment of forged texture and removal of internal stress. The test for dezincification corrosion resistance was carried out based on the method of the ISO type dezincification test. This method comprised finishing the surface of a given test piece with an emery paper No. 1000, washing the polished sample with ethanol, immersing the washed sample in an aqueous 1% cupric chloride solution at 75±3° C. in such a manner that the amount thereof would be not less than 2.5 ml/mm$^2$ of sample surface area, and retaining the sample in the immersed state for 24 hours. The sample which had undergone the immersing treatment was measured for the depth of dezincification from the surface. The dezincification corrosion resistance was rated by the depth of dezincification on the three-point scale, wherein ◎ stands for a depth of not more than 75 μm, ○ for a depth in the range of 75 to 200 μm, and × for a depth of not less than 200 μm.

The details of the results of test shown in Table 1 will be described below.

Sample No. 1 was deficient in dezincification resistance because it had an unduly low Cu content and contained virtually no P or Sn. Samples No. 2 to No. 4 showed fine dezincification corrosion resistance because they contained 0.09 to 0.10% of P, but showed unsatisfactory forgeability because it had an unduly high Cu content. Sample No. 5 was deficient in dezincification corrosion resistance because it contained no Sn. Sample No. 6 was deficient in dezincification corrosion resistance because it contained no P. Samples No. 7 to No. 12 showed satisfactory dezincification corrosion resistance because they had P and Sn contents of 2.81–3.98 as calculated from the formula of P (%)×10+Sn (%). While Samples No. 7 to No. 10 excelled in forgeability as well, Samples No. 11 and No. 12 sustained cracks due to hot forging because they had unduly high P contents. Samples No. 13 to No. 15 showed satisfactory forgeability because they had low Cu contents and did not show fine dezincification corrosion resistance because they had unduly low Sn contents.

From the results discussed above, it is clear that Samples No. 7 to No. 10 answering the formula, P (%)×10+Sn (%)=2.81 to 3.98, excelled in both dezincification corrosion resistance and hot forging property. Since an unduly high Sn content has the possibility of inducing heavy precipitation of the y phase in the alloy texture, Sample No. 10 had an Sn content of 2.98%.

It is concluded, therefore, that Samples No. 7 to No. 10 which answered the formula, P (%)×10+Sn (%)=2.81 to 3.98, were fully satisfactory. Particularly, it has been confirmed that where P (%)=0.07 to 0.10, the formula, P (%)×10+Sn (%)=2.8 to 3.2, proves favorable.

Figure 9:
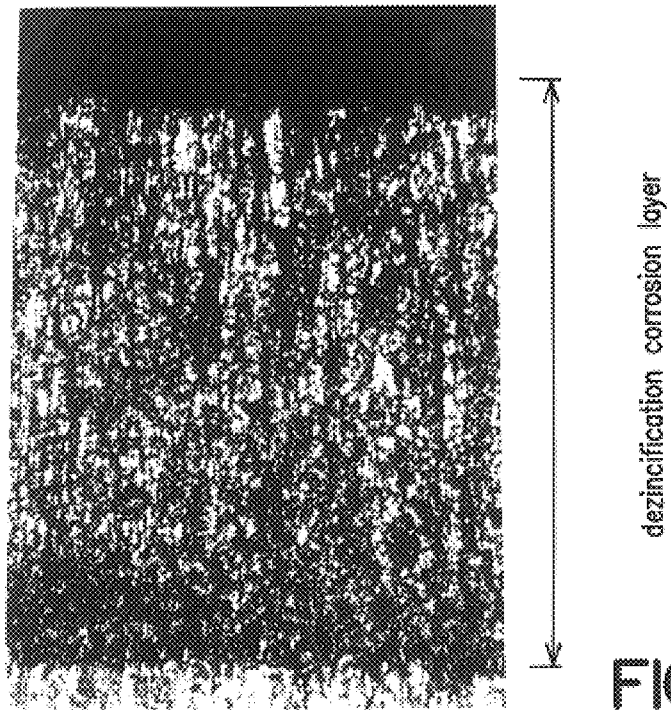
FIG. 9 is a copy of the micrograph of a sample obtained by performing an ISO type dezincification corrosion test on a valve part produced by forging a conventional forging grade brass bar specified by JIS C3771.
Figure 10:
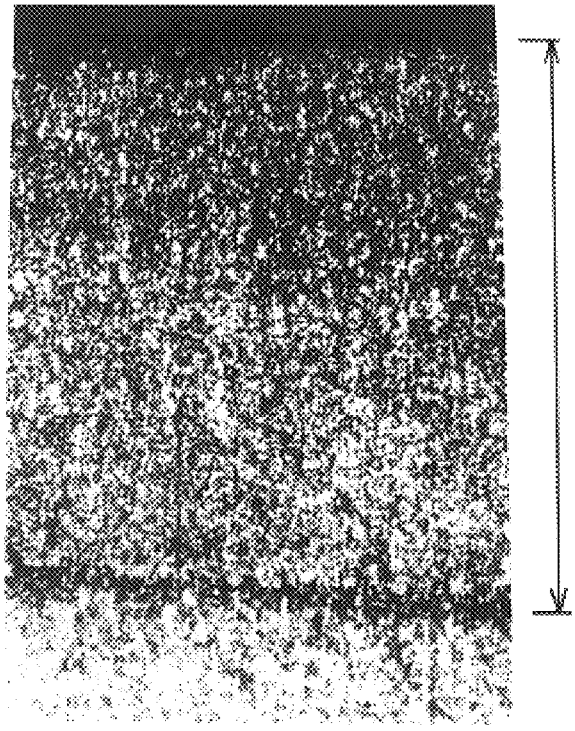
FIG. 10 is a copy of the micrograph of a sample obtained by performing an ISO type dezincification corrosion test on a part produced by working a conventional free-cutting brass bar specified by JIS C3604.

FIG. 9 (Sample No. 1 in Table 1) is a copy of the photograph of a corroded part which appeared on the sample obtained by hot-forging the known forging brass bar (JIS C3771) after the sample had undergone the ISO-6509 type test for dezincification corrosion resistance. From the photograph, the occurrence of layers of dezincification corrosion, about 1000 μm to 1400 μm in depth, is confirmed. The results of the same test performed on a free-cutting brass bar (JIS C3604) are shown in FIG. 10. From this Figure, the occurrence of layers of dezincification corrosion, 1000 μm to 1400 μm in depth, is confirmed similarly in FIG. 9.

Figure 7:
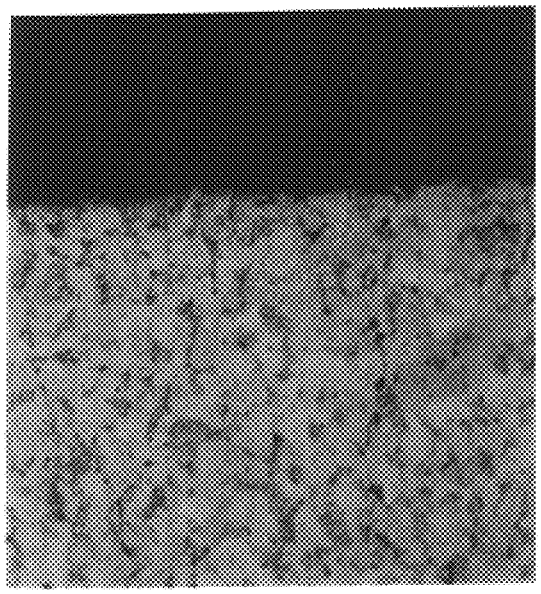
FIG. 7 is a copy of the micrograph of a sample obtained by performing an ISO type dezincification corrosion test on the material of this invention (Sample No. 7 shown in Table 1).
Figure 8:
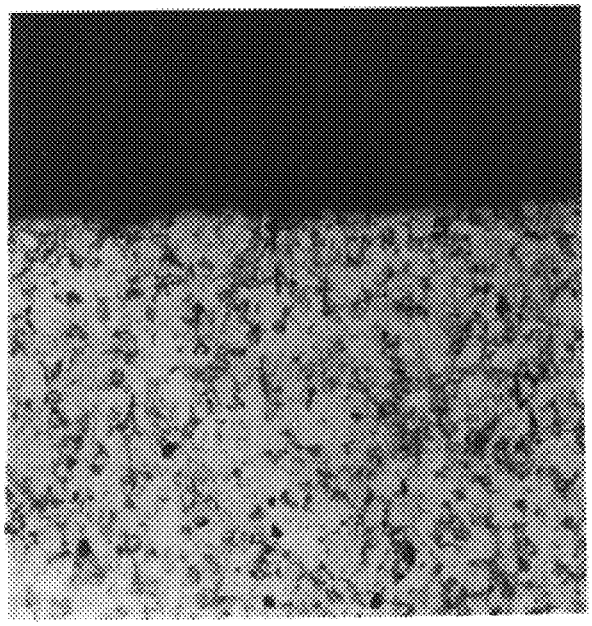
FIG. 8 is a copy of the micrograph of a sample obtained by performing an ISO type dezincification corrosion test on the material of this invention (Sample No. 8 shown in Table 1).

FIG. 7 (Sample No. 7 in Table 1) and FIG. 8 (Sample No. 8 in Table 1) are each a copy of the photograph of the results of a test for corrosion performed in accordance with the ISO-6509 type dezincification corrosion testing method on a sample produced by subjecting the forming brass bar of this invention to a hot forging and heat treatment. It is clearly noted from these results that the samples showed virtually no sign of corrosion and proved satisfactory in corrosion resistance as evinced by depths much smaller than 75 μm as a criterion for rating. The data demonstrate that the alloy of this invention is a copper-based alloy capable of manifesting an excellent effect in resisting dezincification corrosion.

Figure 11:
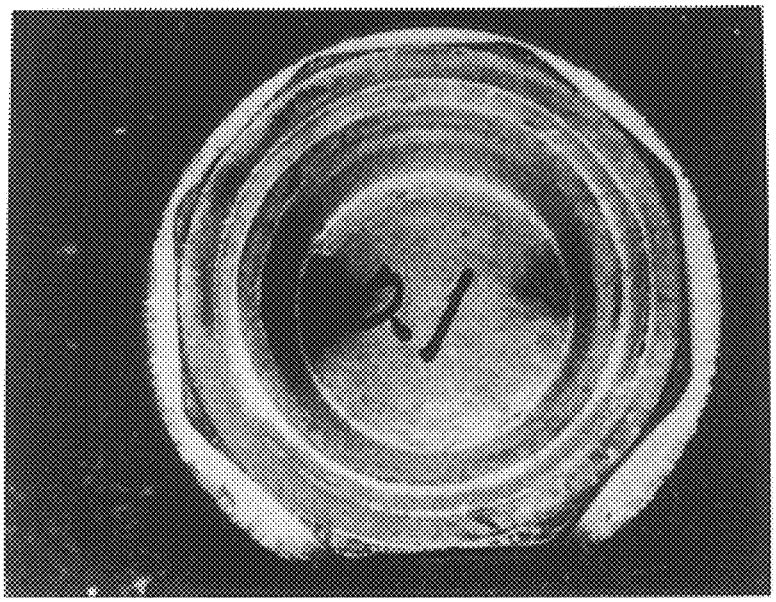
FIG. 11 is a copy of the photograph of the appearance of a forged product (valve part) using the material of this invention (Sample No. 7 shown in Table 1).

FIG. 11 depicts a sample of the valve part obtained by forging the copper-based alloy of Sample No. 7 (P 0.10%) of this invention shown in Table 1 at a heating temperature of 720° C. The appearance was examined by visual observation and by the use of a stereoscopic microscope capable of 10 magnifications to determine the presence or absence of defects such as cracks in the surface layer. By the test results, the sample was found to be satisfactory as evinced by the absence of any discernible sign of defects such as cracks.

Figure 12:
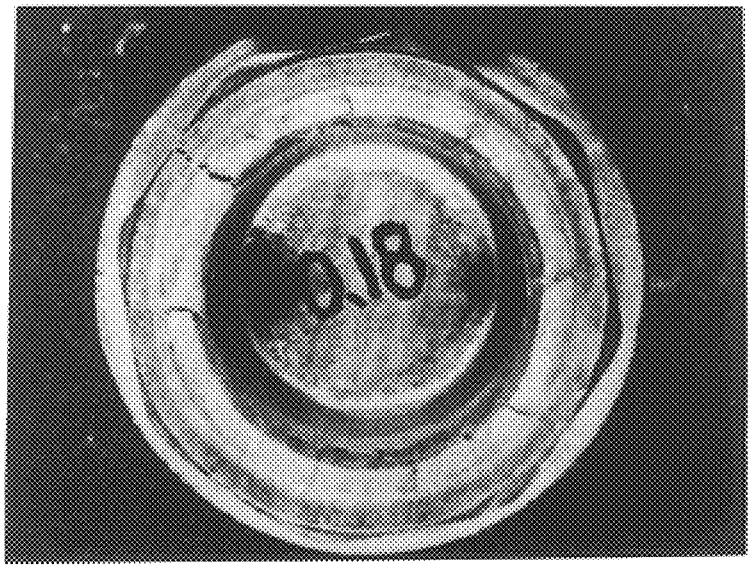
FIG. 12 is a copy of the photograph of a forged product (valve part) using Sample No. 12 shown in Table 1, in a state sustaining a crack on the surface thereof FIG. 13(*a*) is a copy of the photograph of two samples of the extruded product using the material of this invention, one of the samples sustaining no crack (extrusion 550° C.×3.0 Hr annealing→drawing→350° C.×3.0 Hr annealing) and the other sample sustaining a crack (extrusion→550° C.×3.0 Hr annealing→drawing), and FIG. 13 (6) is an explanatory diagram of the photographed samples.

FIG. 12 depicts a sample of the valve part obtained by forging the sample material of Comparitive Example No. 12 (P 0.18%) shown in Table 1 at a forging temperature of 720° C. The sample sustained a crack in the surface layer. The occurrence of this crack was due to an unduly high P content of the alloy. The results indicate that the hot processing property becomes unsatisfactory when the P content is 0.18%.

The test examples and the working examples for demonstrating the excellence of the alloy of this invention in resistance to stress-corrosion cracking will be described below.

Figure 15:
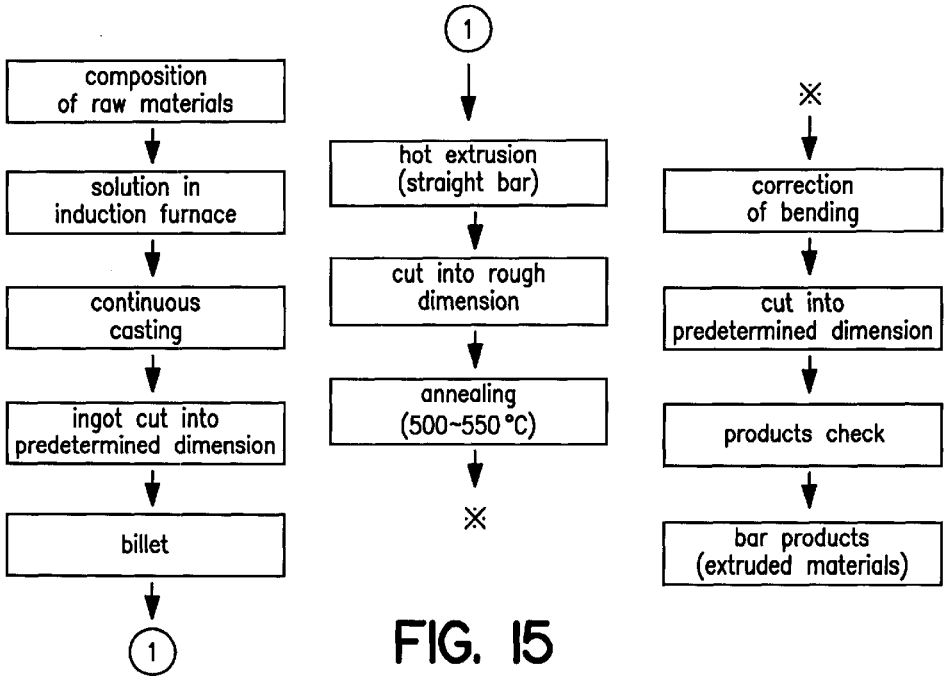
FIG. 15 is an explanatory diagram illustrating a process for the production of Sample (1) of the alloy of this invention.
Figure 16:
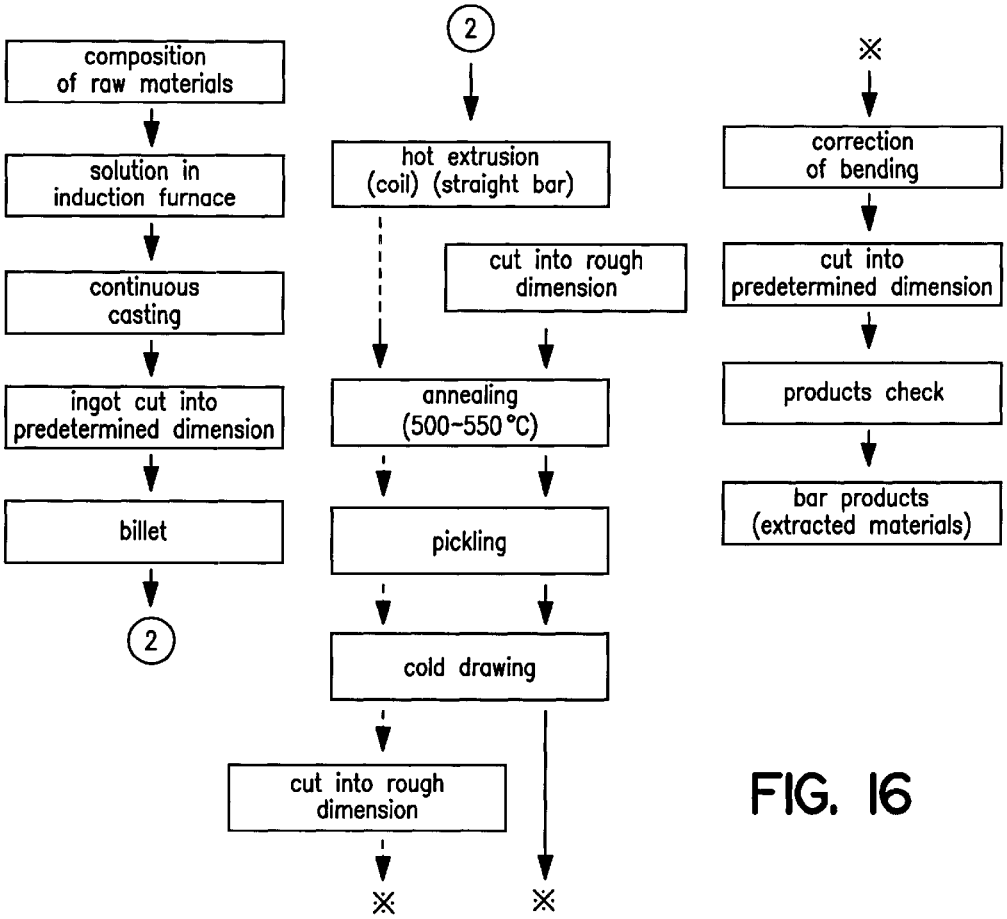
FIG. 16 is an explanatory diagram illustrating a process for the production of Sample (□) of the alloy of this invention.
Figure 17:
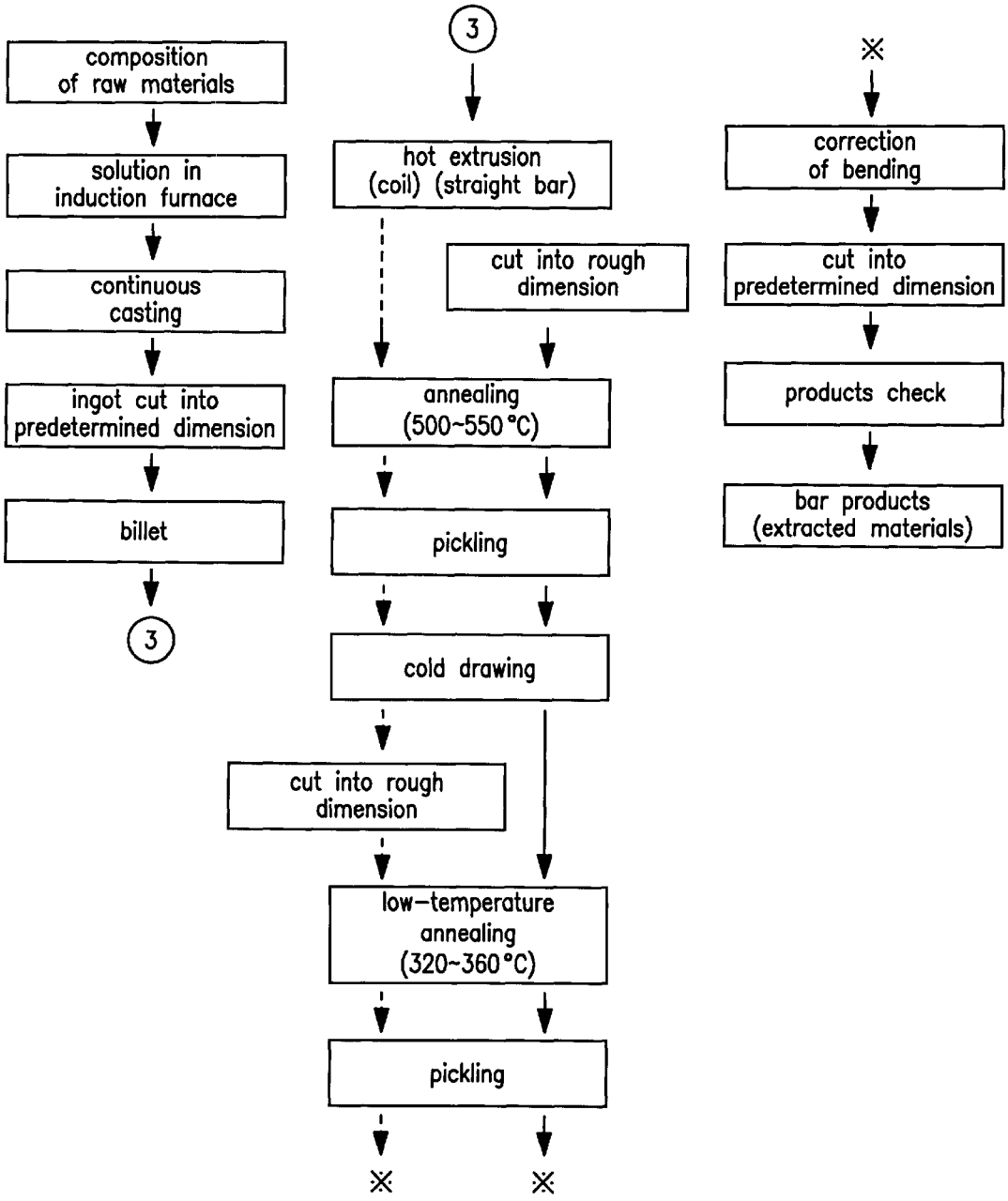
FIG. 17 is an explanatory diagram illustrating a process for the production of Sample (△) of the alloy of this invention.

When the copper-based alloy of this invention is to be manufactured into a free-cutting material, the standard process possibly proceeds through either the course of "annealing→shipping" or the course of "annealing→drawing→shipping", after the hot extrusion of the billet as illustrated in FIG. 15 to FIG. 17, depending on the shape, size and other similar factors of the relevant bar material. Further, the course of "annealing →drawing→annealing→shipping" illustrated in FIG. 17 is now proposed by this invention. The bar materials produced by the methods using these three different courses were tested for stress cracking and other properties. Table 2 illustrates the samples and the processes involved.

The methods used for the production of the samples will be described below. For the tests, straight bar materials of Sample (イ) 16 mm in diameter and coil materials of Samples (ロ) and (ハ) 18.2 mm in diameter, were produced by hot-extruding billets measuring 250 mm in diameter and having the same composition as Sample no. 7 shown in Table 1. The sample (イ) shown in Table 2 was obtained by subjecting the bar material 16 mm in diameter resulting from the hot extrusion to a heat treatment which consisted of standing at 550° C.×3.0 hours and air cooling. The sample (ロ) was obtained, in accordance with the process of FIG. 16, by subjecting the coil material resulting from the hot extrusion to a heat treatment which consisted of standing at 550° C.×3.0 hrs and air cooling, then drawing the hot-extruded material into a bar 16 mm in diameter, and working and plastic-working the drawn material into predetermined dimensions. Further, the sample (ハ) shown in Table 2 was obtained, in accordance with the process of FIG. 17, by subjecting the coil material resulting from the hot extrusion to a heat treament which consisted of standing at 550° C.×3.0 hrs and air cooling, then working and plastic-working the product of this heat treatment by the drawing process into predetermined dimensions, and subjecting the drawn material to a heat treatment which consisted of standing at 350° C.×3.0 hrs and air cooling. The samples (□) and (△) both had a ratio of reduction of area of 22.7%. The samples produced by the three processes mentioned above were tested for stree-corrosion cracking and mechanical properties.

The results of the tests and the evaluations thereof are show in Table 2.

Figure 14:
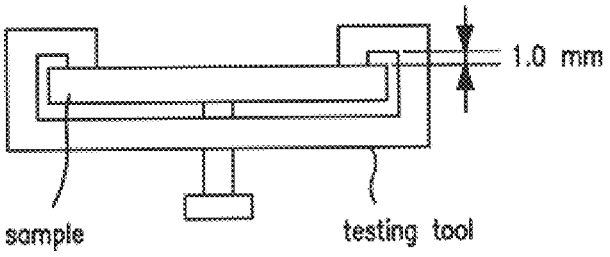
FIG. 14 is an explanatory diagram illustrating a tool used for the stress-corrosion cracking test performed under pressure.

Test for stress-corrosion cracking: The test of a bar material as it is for stress-corrosion cracking was carried out in accordance with the season cracking test specified in JIS H3250. A length, 80 mm, cut from a given sample bar material of the varying process mentioned above was degreased, dried, then placed in a dessicator holding a pool of a 14% aqua ammonia on the bottom thereof, and left standing in the atmosphere of ammonia at room temperature for two hours. The sample which had undergone the test was cleaned with an aqueous 10% sulfuric acid solution, further washed with water, thoroughtly dried, and visually examined in search of a surface crack. The test for stress-corrosion cracking under application of pressure was carried out by preparing a testing tool constructed as shown in FIG. 14, setting a given sample in the testing tool, placing the sample as set in the testin tool in the same desiccator holding a pool of a 14% aqua ammonia as used in the test mentioned above, retaining the sample therein for two hours, and thereafter cleaning the sample in the same manner as in the test mentioned above, and visually examining the cleaned sample in search of a surface crack. A sample bearing a discernible sign of crack was labeled with a cross (×) mark and a sample bearing no discernible sign of crack was labeled with a circle (○).

Now, the results of the test of the copper-based alloy of this invention for mechanical properties and the test thereof for stress-corrosion cracking and the evaluations thereof shown in Table 2 will be described below.

The sample (◁) in the form of a bar material as extruded did not sustain any stress-corrosion crack but sustained a crack in the test performed under application of pressure. This behavior of the sample (◁) maybe logically explained by a supposition that the sample was so deficient in material strength as to yield to the pressure applied, sustain minute plastic deformations, and suffer to retain residual internal stress in the minute plastic deformations, and sustain eventually the crack.

The bar material of the sample (□) sustained a crack in any of the tests performed under application of pressure. The residue of the large internal energy inflicted on the sample by the drawing work was responsible for the crack. The large internal stress which persisted because of high rigidity and poor toughness and because of the fact the internal stress was exerted during the application of pressure gave rise to the crack.

Figure 13A:
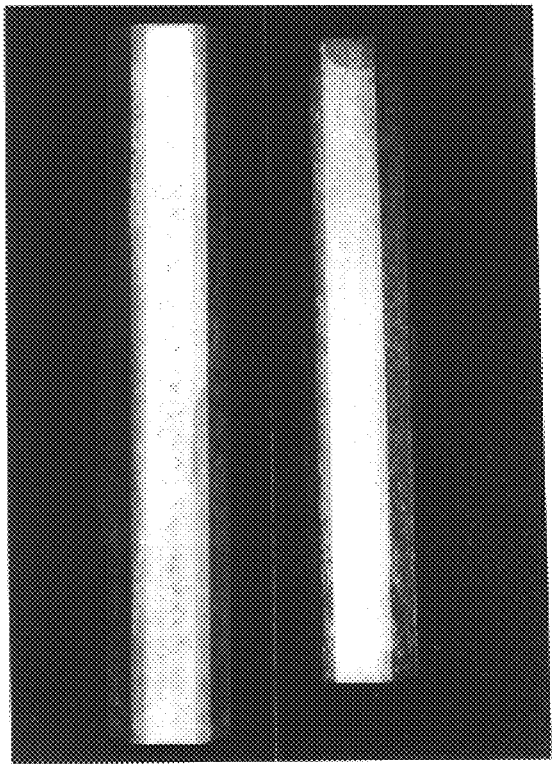
Figure 13B:
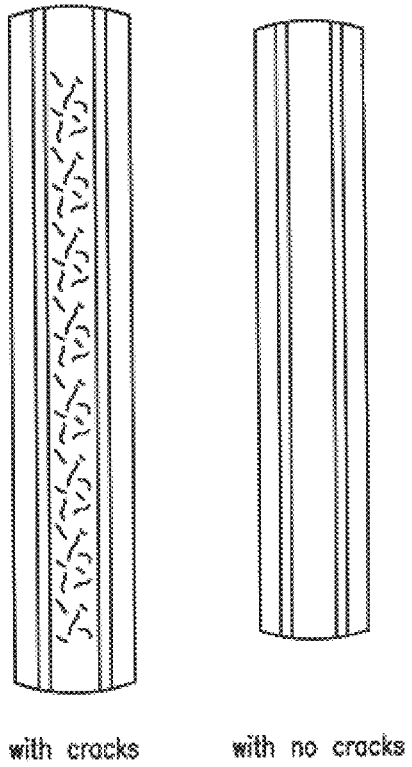

Then, the sample (△) sustained no crack in either the test performed on a bar material or the test performed under application of pressure. This sample was enabled to gain in material strength by the plastic working effected by the drawing work and then converted into a material of high strength by the subsequent work of stress relief annealing which was intended to remove internal stress. This material, consequently, acquired a high threshold value enough to resist the fracture due to an externally exerted stress. Thus, it could withstand the stress exerted during the application of pressure and did not sustain any crack. The results demonstrate that the treatments adopted in the same process as in the production of the sample (△) afford a product which excels in dezincification corrosion resistance and in stress-corrosion cracking resistance as well. The copy of photograph found in FIG. 13(*a*) shows the results of the test for stress-corrosion cracking performed in a 14% aqua ammonia for two hours.

From, the results described above, it can be concluded that the copper-based alloy according to this invention which is produced by a process of extrusion→heat treatment (standing at 475 to 660° C. for 1.0 to 5.0 hours and air cooling)→drawing work (ratio of reduction of area 10 to 30%)→heat treatment (standing at 250 to 400° C. for 1.0 to 3.0 hours and air cooling or furnace cooling) excels in dezincification corrosion resistance and stress-corrosion cracking resistance as well.

As described above, therefore, the copper-based alloy according to this invention can be extensively applied to mechanical members such as hose nipple parts and other similar caulking assembly parts, valve stems and disks which are destined to be exposed to stress and used in corrosive aqueous solutions.

Industrial Applicability

It is clear from the description given above that the copper-cased alloy of this invention can be extensively applied to materials such as for valves, valve bodies, stems, disks and other valve parts, building materials, materials for machinal members for electrical, mechanical, marine and automotive engineerings, and materials for plant members handling salt water, which require to offer resistance to dezincification corrosion.

As concrete examples of the members or parts for which the copper-based alloy of this invention is suitably used as raw materials, water-contacting parts of valves and water faucets, specifically ball valves, hollow balls for ball valves, butterfly valves, gate valves, globe valves, check valves, hydrants, mounting brackets for hot-water suppliers and hot-water cleaning toilet seats, water supply pipes, connecting pipes, pipe joints, coolant pipes, electric hot-water supply parts (casings, gas nozzles, pump parts, burners, etc.), strainers, parts for water meters, parts for water supply, medium water supply and sewage systems, draining plugs, elbows bellows, connecting flanges for toilet seats, spindles, joints, headers, branching plugs, hose nipples, auxiliary brackets for water faucets, waterstop plugs, supplies for water feeding and draining plugs, mounting brackets for sanitary ceramics, connecting pieces for shower hoses, gas appliances, doors, knobs, and other building materials and household electric appliances may be cited. Further, the copper-based alloy can be applied to raw materials, intermediate products, final products and assemblies such as toilet articles, kitchen utensils, bathroom accessories, washroom utensils, furniture parts, living room articles, sprinkler parts, door parts, gate parts, automatic vendor parts, washing machine parts, air conditioner parts, gas welder parts, heat exchanger parts, solar heat hot-water supply parts, metal dies and parts thereof, bearings, toothed wheels, constructional machine parts, parts for rolling stock, and transport machine parts, for example.

TABLE 1

| sample No. | | chemical components (%) Cu | Pb | P | Sn | Ni | Ti | Zn | P × 10 + Sn | forging property | dezincification-corrosion resistance |
|---|---|---|---|---|---|---|---|---|---|---|---|
| 1 | comparative example | 58.95 | 2.23 | — | 0.06 | — | — | remainder | — | ○ | × |
| 2 | comparative example | 64.21 | 2.18 | 0.09 | 1.15 | — | — | remainder | 2.05 | × | ◎ |
| 3 | comparative example | 63.46 | 2.25 | 0.09 | 1.20 | — | — | remainder | 2.10 | × | ◎ |
| 4 | comparative example | 62.22 | 2.26 | 0.10 | 1.24 | — | — | remainder | 2.24 | × | ◎ |
| 5 | comparative example | 61.03 | 2.30 | 0.09 | — | — | — | remainder | — | ○ | ○ |
| 6 | comparative example | 61.18 | 2.25 | — | 1.19 | — | — | remainder | — | ○ | × |
| 7 | this invention | 60.46 | 2.28 | 0.10 | 2.43 | 0.10 | — | remainder | 3.23 | ○ | ◎ |
| 8 | this invention | 60.35 | 2.24 | 0.08 | 2.11 | 0.10 | 0.09 | remainder | 3.01 | ○ | ◎ |
| 9 | this invention | 60.35 | 2.20 | 0.07 | 2.11 | 0.08 | — | remainder | 2.81 | ○ | ◎ |
| 10 | this invention | 60.18 | 2.27 | 0.10 | 2.98 | 0.09 | 0.08 | remainder | 3.98 | ○ | ◎ |
| 11 | comparative example | 60.08 | 2.31 | 0.20 | 1.20 | 0.12 | — | remainder | 3.20 | × | ◎ |
| 12 | comparative example | 60.65 | 2.18 | 0.18 | 1.30 | 0.11 | 0.07 | remainder | 3.10 | × | ◎ |
| 13 | comparative example | 58.59 | 2.20 | 0.09 | 1.22 | — | — | remainder | 2.12 | ○ | × |
| 14 | comparative example | 57.85 | 2.35 | 0.09 | 1.20 | — | — | remainder | 2.10 | ○ | × |
| 15 | comparative example | 57.30 | 2.23 | 0.09 | 1.18 | — | — | remainder | 2.08 | ○ | × |

TABLE 2

| sample No. | types of process | process for producing bar | mechanicals properties hardness (Hv) | tensile strength (N/mm$^2$) | elongation (%) | test for stress-corrosion crack in the form of extruded bar material | test for stress-corrosion crack under application of pressure |
|---|---|---|---|---|---|---|---|
| イ | FIG. 15 | hot extruding → 550° C. × 3 Hr annealing | 84 | 350 | 49 | with no crack | × |
| ロ | FIG. 16 | hot extruding → 550° C. × 3 Hr annealing → drawing process (ratio of reduction of area 22.5%) | 157 | 460 | 31 | with many cracks | × |
| ハ | FIG. 17 | hot extruding → 550° C. × 3 Hr annealing → drawing process (ratio of reduction of area 22.5%) → 350° C. × 3 Hr annealing | 123 | 434 | 40 | with no crack | ○ |

What is claimed is:

1. A copper-based alloy excellent in corrosion resistance, having a composition comprising 58.0 to 63.0% of Cu, 0.5 to 4.5% of Pb, 0.07 to 0.10% of P, 2.11 to 2.98% of Sn, 0.05 to 0.30% of Ni, and the balance of Zn and inevitable impurities (weight %), wherein a percentage ratio of P and Sn satisfies the formula of P(%)×10=(2.8 to 3.98)(%)−Sn (%).

2. A copper-based alloy excellent in corrosion resistance according to claim 1, wherein said composition further includes 0.02 to 0.15% of Ti.

3. A copper-based alloy excellent in corrosion resistance according to claim 1, that has a metal composition adjusted so that an average crystal grain diameter is not more than substantially 20 $\mu$m by extruding a billet and heat-treating a product of extrusion at a temperature of not more than a predetermine temperature.

4. A copper-based alloy excellent in corrosion resistance according to claim 1, that is a bar material, into which said billet is extruded at a temperature lowered to not more than 680° C. and which has a crystal grain diameter fragmented uniformly.

5. A copper-based alloy excellent in corrosion resistance according to claim 1, that has undergone a proper drawing process and heat treatment subsequent to an extrusion process of a billet.

6. A method for the production of a copper-based alloy excellent in corrosion resistance as set forth in claim 1, which comprises extruding a cast billet, heat-treating a product of extrusion at a temperature in the range of 475 to 600° C. for a period in the range of 1 to 5 hours, and subjecting a resultant product to a drawing work at a suitable ratio of reduction of area.

7. A method for the production of a copper-based alloy excellent in corrosion resistance according to claim 6, wherein said drawing work is effected by a plastic processing at a 10 to 30% ratio of area reduction to exalt material strength.

8. A method for the production of a copper-based alloy excellent in corrosion resistance according to claim 6, wherein a product of drawing is subjected to heat treatment at a temperature in the range of 250 to 400° C. for a period in the range of 1 to 5 hours to perform adjustment of material and removal of residual stress.

9. A water-contacting part that is produced from the copper-based alloy excellent in corrosion resistance according to claim 1.

10. A water-contacting part according to claim 9, which is selected from the group consisting of valves, joints, pipes, water faucets, supplies for cold water-feeding and supplies for hot water-feeding.

11. An electrical or mechanical product that is produced from the copper-based alloy excellent in corrosion resistance according to claim 1.

12. A product according to claim 11, which is selected from the group consisting of gas appliance parts, washing machine parts and air conditioning parts.

13. A copper-based alloy excellent in corrosion resistance, having a composition comprising 58.0 to 63.0% of Cu, 0.5 to 4.5% of Pb, 0.07 to 0.10% of P, 2.11 to 2.98% of Sn, 0.05 to 0.30% of Ni, and the balance of Zn and inevitable impurities (weight %), wherein a percentage ratio of P and Sn satisfies the formula of P(%)×10=(2.8 to 3.98)(%)−Sn (%), wherein the alloy has undergone heat treatment at a temperature in the range of 450 to 600° C. for a period in the range of 1 to 5 hours subsequent to forging of a product of extrusion of a cast billet.

* * * * *